US006148452A

United States Patent [19]

Kirsopp

[11] Patent Number: 6,148,452

[45] Date of Patent: Nov. 21, 2000

[54] CLOSURE FOR SHOWER CURTAINS

[76] Inventor: Derek Kirsopp, 14 Seadrift Ave., Highlands, N.J. 07732

[21] Appl. No.: 09/307,480

[22] Filed: May 10, 1999

[51] Int. Cl.[7] ..... A47K 3/22

[52] U.S. Cl. ..... 4/609

[58] Field of Search ..... 4/558, 608, 609

[56] References Cited

U.S. PATENT DOCUMENTS

| | | | |
|---|---|---|---|
| 3,639,919 | 2/1972 | White | 4/608 X |
| 3,879,806 | 4/1975 | Armstrong | 4/608 X |
| 4,759,087 | 7/1988 | Zeilinger | 4/608 X |
| 4,765,001 | 8/1988 | Smith | 4/609 |
| 4,887,324 | 12/1989 | Cairns | 4/609 |

*Primary Examiner*—Charles E. Phillips
*Attorney, Agent, or Firm*—Richard A. Joel, Esq.

[57] ABSTRACT

A system from converting a bathtub area into an enclosed substantially waterproof shower enclosure. Closure frames are mounted at each end of the shower curtain to engage retention frames mounted on opposed walls of the enclosure. Each end of the shower curtain is retained within a vertically disposed U-shaped channel having longitudinal ridges therein and a flexible rubber grommet spline or locking rod running lengthwise. The preferred material is rigid PVC. The edge of the shower curtain is rolled about the flexible spline which is then press filled into the U-shaped channel. The curtain is frictionally secured between the spline and the internal walls of the U-shaped channel.

9 Claims, 4 Drawing Sheets

CLOSURE FOR SHOWER CURTAINS

CROSS-REFERENCE TO RELATED APPLICATIONS

NONE

STATEMENT REGARDING FEDERALLY SPONSORED RESEARCH OR DEVELOPMENT

NOT APPLICABLE

BACKGROUND OF THE INVENTION

1. Field of Invention

This invention relates to closures for showers and bathtubs and more specifically to what is commonly referred to as a shower curtain.

DESCRIPTION OF RELATED ART INCLUDING INFORMATION DISCLOSED UNDER 37 CFR §§1.97–1.98

In particular, the device of the present invention is related to an improved closure device for shower curtains. The device may also be used in connection with tarps, curtains, and covers and other related fields where a closing device for a curtain-like structure is employed. Utilization of shower curtains to try to prevent water from the shower from going outside the shower enclosure at the edges is well known.

Shower curtains are often pulled away from the edge of the shower of tub enclosure by the vacuum created by the velocity of the water from the shower head according to well-known phenomena.

Often the typical shower curtain does not adequately prevent water from spilling onto the bathroom floor as the curtain moves away from the shower walls due to the decreased pressure of air entrained with the water spray. In addition, this effect can be due to an open window or door blowing the curtain. A further problem arises since household pets such as cats like to sleep in cool places such as the shower.

Attempts have been made to keep shower curtains in place by wetting the edge of the shower enclosure wall and sticking the curtain to it. Other devices include magnets or suction cups at the bottom of the shower curtain to keep the curtain against the inside of the bathtub walls. These techniques do not prevent the water escaping through the sides onto the floor. Also when it is necessary to remove the curtain for cleaning or washing, the magnets or suction cups would often break in the washing machine, making the arrangement useless.

It is the purpose of the present invention to provide a shower closure device for a curtain which is aesthetically appealing with the curtain attached and which causes water to remain inside of the tub instead of spilling onto the floor. The curtain will not be blown aside drafts from open windows. The device is easily installed and removed for cleaning of the curtain. It gives the appearance of a sealed door enclosure without the high cost of installing a conventional glass shower tub enclosure. In addition it serves to keep pets out of the tub.

The closest prior art references of which the applicant is aware of are as follows:

U.S. Pat. No. 2,761,140 to Kellogg discloses a shower curtain unit for use with built-in bathtubs. Notable in this patent is the utilization of a vertical tube 45 secured at each end by the internal rods 47 and 48, and retained in brackets at the top and bottom of the tube enclosure. The shower curtain 19 is hemmed at the end, with an opening provided in the hem through which the tube 45 is fitted.

U.S. Pat. No. 4,887,324 to Cairns discloses a curtain retainer apparatus which is noted for its method of retaining the curtain 138 and flexible retainer means having beaded interlocking heads as shown in the drawings. This is particularly useful for shower curtains.

In U.S. Pat. No. 3,205,547 to Riekse a combination of flexible retainer and locking strip 24 is shown in cross-section in FIGS. 3 and 4.

U.S. Pat. No. 3,639,919 to White (see FIGS. 2 and 3), wherein the end of a curtain is retained within the holder having a resilient core 20 fitted into a hem of the curtain 19.

The disclosure in U.S. Pat. No. 2,897,889 to Kessler illustrates a common way of retaining screening utilizing a ribbed resilient cord.

Other patents of general interest in this area are U.S. Pat. No. 2,712,35,4 to Margolies; U.S. Pat. No. 3,187,801 to Saling; U.S. Pat. No. 3,366,161 to Barnett; U.S. Pat. No. 3,855,642 to Blitch; U.S. Pat. No. 4,361,915 to Siewert; U.S. Pat. No. 4,595,741 to Payne; U.S. Pat. No. 5,148,580 to Dyckow; and, U.S. Pat. No. 5,339,884 to Angerman The present invention is a significant improvement over the devices shown in the prior art patents individually and collectively.

SUMMARY OF THE INVENTION

This invention relates to closures for showers and bathtubs and in particular, shower curtains. In accordance with the present invention, a system is provided for converting a bathtub area into an enclosed substantially waterproof shower enclosure by means of adding or modifying the shower curtain installation by providing closure frames at each end of the shower curtain as well as corresponding retention frames that are easily fixed onto opposed walls in the bathtub enclosure for sealingly receiving the side edges of the curtain in a waterproof relationship. Each end of the shower curtain is retained within a vertically disposed U-shaped channel having longitudinal ridges there and a flexible rubber grommet spline or locking rod running lengthwise. The edge of the shower curtain is rolled about the flexible spline which is then pressed fitted into the U-shaped channel. The curtain is securely retained by friction between the spline and the internal walls of the U-shaped channel.

The outer frame comprises two spaced U-shaped channels slightly larger than the channels about which the curtain is rolled and which are frictionally retained in a water tight sealing engagement with the primary frame piece.

The external channels are secured to the installation walls with means such as double stick tape or caulking or threaded fasteners such as Phillips head screws passing through the base of the U of each channel with the open edge of the U facing outwardly towards the shower curtain.

The inner channel or frame is provided with a handle for moving the shower curtain outwardly against the end wall. One frame can serve as the latch and the other is more or less semi-permanently attached to the wall. In effect, one has erected a portable shower enclosure with an easily closable sliding door. Since the inner frames can both open and close the curtain, the user may enter or exit from either end. If desirable, weights may be placed on the lower edge of the curtain to help retain it snugly against the base of the enclosure to further prevent water from reaching the external floor of the room.

Such an improvement greatly increases the utility of an ordinary bathroom and prevents water damage. In addition to keeping the water inside, it serves as a convenient means of excluding pets from the shower area.

Accordingly, an object of this invention is to provide a new and improved shower closure.

Another object of this invention is to provide a new and improved shower closure which is aesthetically appealing and easily installed and removed.

A further object of this invention is to provide a new and improved shower closure which prevent water from spilling outside the shower but is low cost compared to the prior art.

A more specific object of this invention is to provide a new and improved shower closure by providing unique locking rods at the shower walls to which the shower curtain is securely fastened to prevent water from spilling outwardly.

BRIEF DESCRIPTION OF THE DRAWINGS

The above and other objects and advantages of this invention may be more clearly seen when viewed in conjunction with the accompanying drawings wherein.

DETAILED DESCRIPTION OF THE INVENTION

Figure 1:
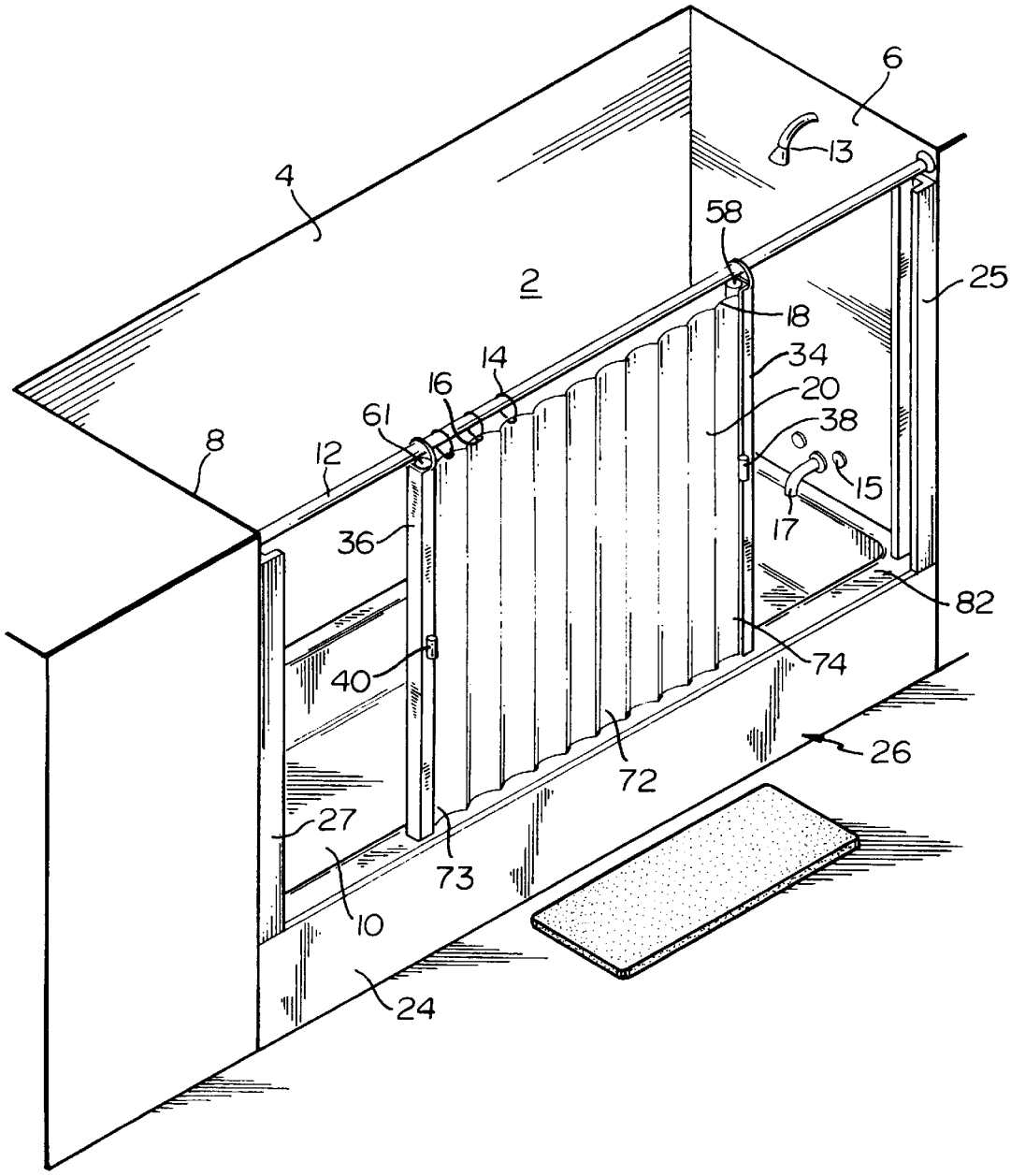
FIG. 1 is a perspective overall view of the device installed in a conventional tub enclosure with a curtain in the open position.

Referring now to the drawings and particularly FIG. 1, a bathtub enclosure is indicated generally at 2 and includes back wall 4, side walls 6 and 8, an open front 10 spanned by shower curtain rod 12, shower nozzles 13, faucets 15, spigot 17 and the outer bathtub wall 24.

A conventional curtain rod 12 spans the space between the walls 6 and 8 and includes the suspension rings 14 which are fitted into apertures 16 in the top edge 18 of the curtain 20. The curtain 20 is in touching relationship with the top edge 82 of the outer wall 24 of the tub 26.

The device 2 of the present invention includes the U-shaped outer vertical channels 25 and 27 on the opposed walls 6 and 8 respectively, secured thereto by screws or conventional sticking means.

Each end 73 and 74 of the curtain 20 has a U-shaped channel 34 and 36 with handle 38 and 40 respectively and latching mechanism secured to it as indicated in FIG. 1.

Figure 2:
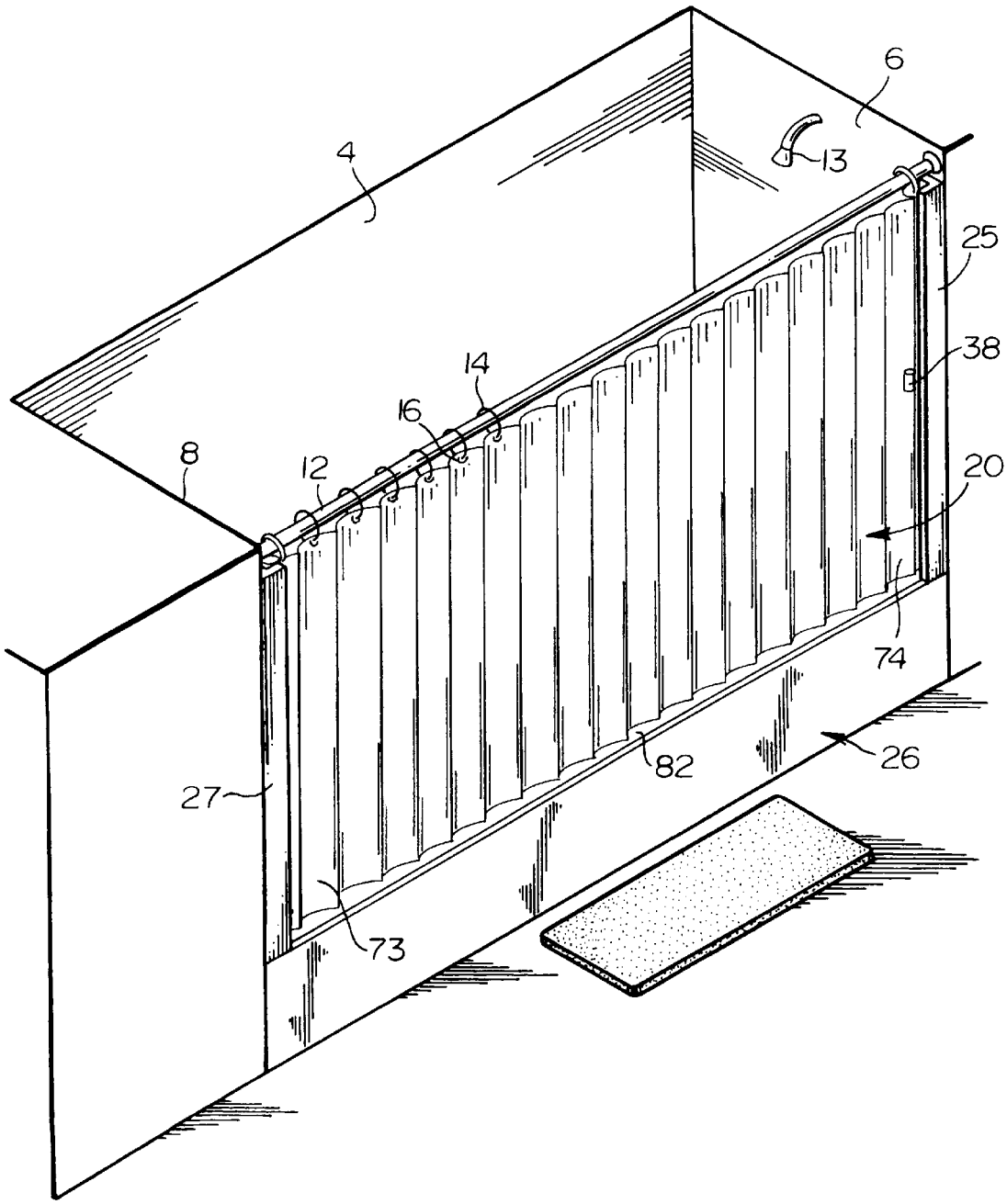
FIG. 2 is a similar view with the curtain in the drawn closed position.

The curtain 20 is shown drawn closed in FIG. 2 with the U-shaped channels 34 and 36 at each end 73 and 74 of the curtain 20 snugly fitting into with the matched U-shaped outer channels 25 and 27 that are vertically secured to the opposed enclosure walls 6 and 8.

The curtain 20 is shown hanging in tangential relationship with the top surface 82 of the tub 26. It is preferred that the curtain 20 hang inside the tub 26 with the curtain 20 sufficiently long to be below the top edge 82 of the tub 26.

The channels 25, 27, 34 and 36 may be comprised of extruded aluminum or stainless steel to resist corrosion or extruded rigid PVC which is preferable due to cost effectiveness and color variation. In the damp environment of the bathroom, particularly in connection with the shower. They are resistant to corrosion, will wipe to a lustrous finish and are very easily cleaned.

Figure 4:
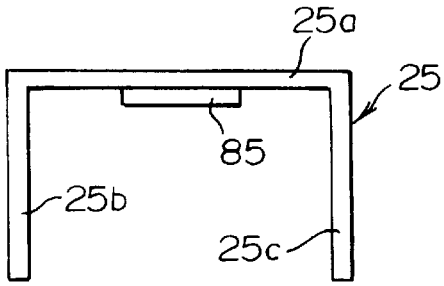
FIG. 4 is a profile view of the U-shaped channel as mounted on the enclosure walls.
Figure 5:
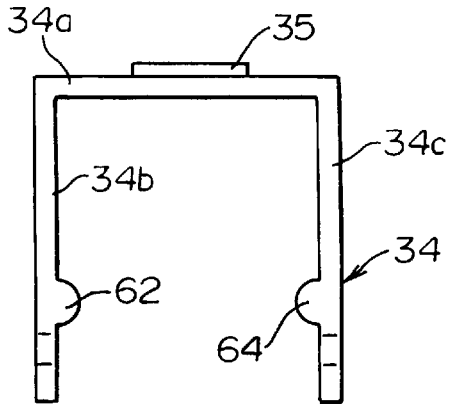
FIG. 5 is a profile view of the U-shaped channel and the portion which encloses the edges of the curtain.

As shown in FIG. 4 the outer channels 25 and 27 are U-shaped in form and dimensioned to be slightly larger and not as deep as the inner channels 34 and 36 as shown in FIG. 5. A magnet 85 is mounted on the base 25*a* between the legs 25*b* and 25*c*. The magnet 35 on the outside of base 34*a* is attached to magnet 25 securing legs 34*b* and 34*c* within legs 22*b* and 22*c*.

Figure 6:
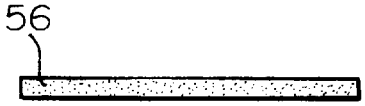
FIG. 6 is an enlarged view of the double-sided tape used to adhere the channel of FIG. 4 to the enclosure wall.
Figure 7:
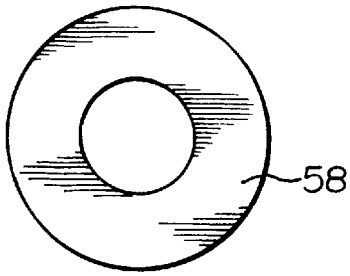
FIG. 7 is a cross-sectional view of the grommet spline.
Figure 8:
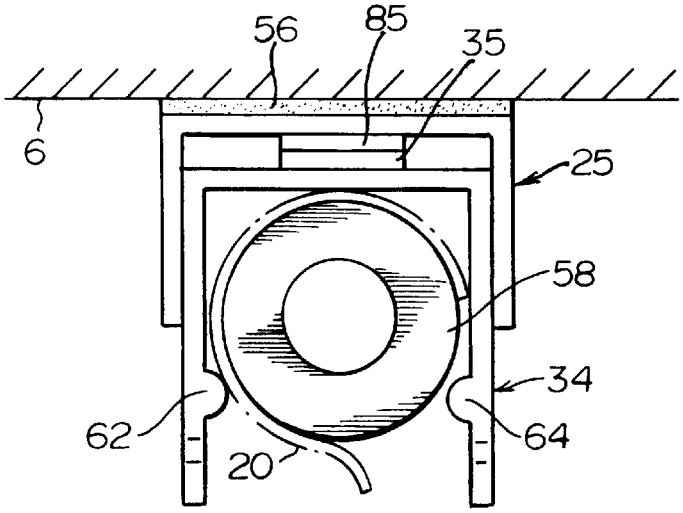
FIG. 8 is a cross-sectional assembly showing the channel mounted on the wall with the end channel for grasping the curtain edges and retaining them between the channel walls and semi-rigid grommet spline.

FIG. 6 shows a cross-section of doubled sided sticky tape 56 for adhering the U-shaped channel 25 to the walls 6 and 8 as shown and indicated in FIG. 8 FIG. 7 is a cross-section of the hollow grommet spline 58 and 61. The splines 58 and 61 may include notches or they may be omitted. FIG. 8 shows a cross-section of the assembled U-shaped channels 25, 27, 34 and 36 with the grommet spline 58, 61 squeezed into the inner channels 34 behind the protruding ridges 62 and 64, compressing the shower curtain 20 material which is wrapped around it and frictionally secured between the grommets 58 and the walls 34*b* and 34*c* of the inner U-shaped channels 34 and the ridges 62 and 64 thereon.

The outer channels 25, 27 which are adhered to the shower walls 6 and 8 may have a small notch cut on the bottom inside edge. This notch will allow the curtain's bottom edge to fit more securely within the channels 25, 27 when the curtain 20 is closed. If the outer channel 25 or 27 needs to be trimmed to fit into the enclosure it may be trimmed from its top edge. The inner channel 34 which the curtain 20 is secured within, has two ridges 62 and 64 but more ridges may be included as an option on the sides or on the inside front wall FIG. 3 in an enlarged perspective view shows the holes 16 into which the turned in ends of the shower curtain hooks 14 may be placed and used to hold up the curtain 20 or an alternative style hook may be used.

Two handles 38 and 40 shown in FIG. 2 are provided, one on the external side 73 at each end 72 and 74 of the curtain 20 and secured to the U-shaped channels 34 and 36 by suitable fasteners 76 such as rivets or screws in a known manner. Also two handles (not shown) are on the inside of each end. As an alternative, the handles 38 and 40 may merely be a pressed indentation in the form of a hole in which a finger may be placed to open the curtain.

Figure 3:
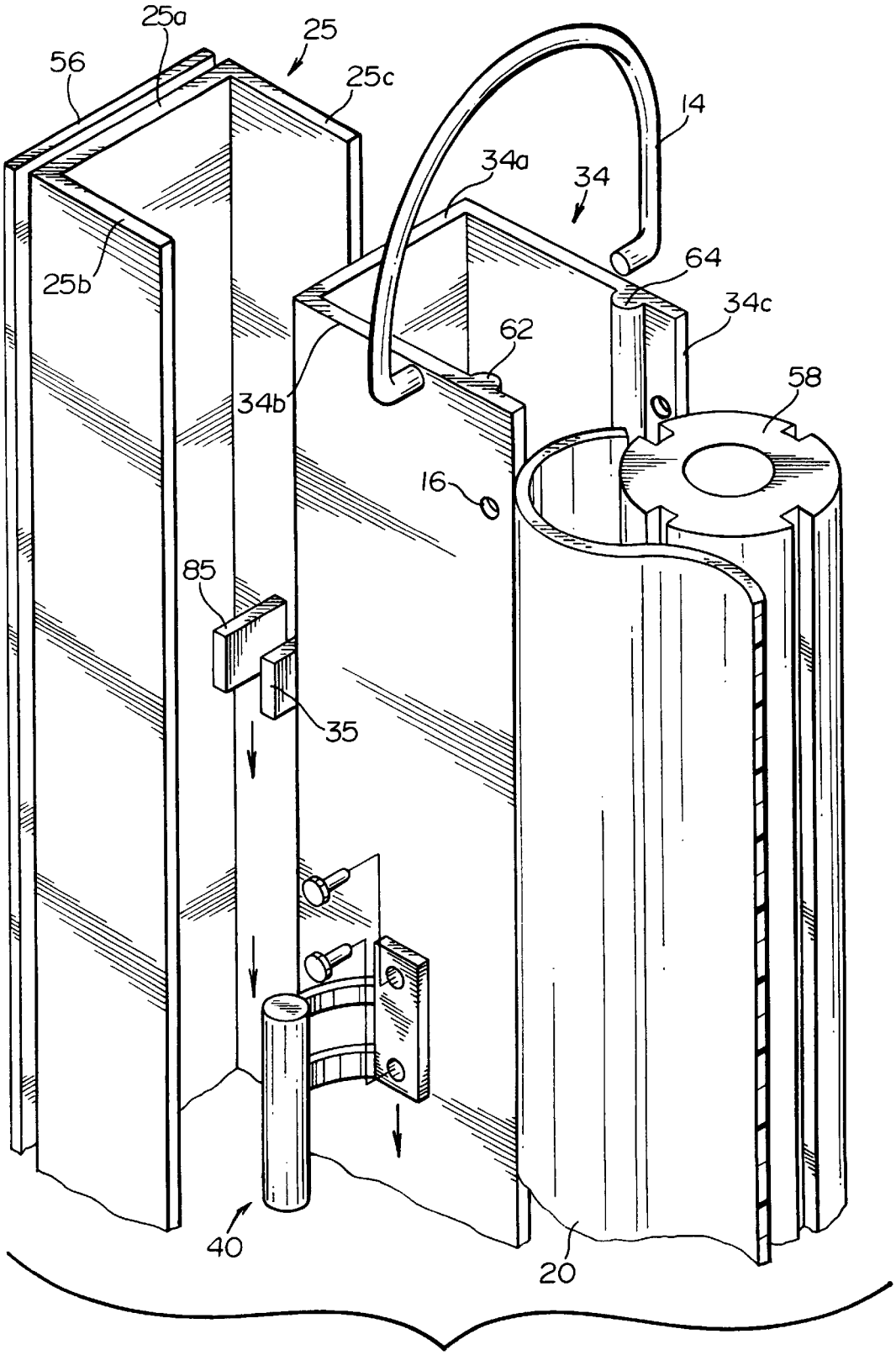
FIG. 3 is an enlarged perspective view of the details of the main components of the system and the relationship to each other including the frame for the enclosure and the portion grasping the shower curtain.

The curtain 20 is latched on the outer channels 25 and 27 with magnetic catches 35 and 85 as shown. The grommet splines 58 and 61 may be textured with indented ridges or raised ridges 82 as shown in FIG. 3 to provide additional frictional resistance to hold the wrapped curtain in place.

The structure of the device 2 is very simple to fabricate comprising pairs of U-channels, the handles 38 and 40 the grommets 58 and 61, doubled sided tape 56 and bumper strips. Self-tapping screws 26 or appropriate adhesive may be utilized for securing the stainless steel, PVC or aluminum to the channel and wall surfaces 6 and 8 such as tile, sheetrock or, plaster surfaces. They provide a water-tight seal.

The spline material should be pliable not just to provide a water-tight seal but to be easily removed by a razor blade or similar tool if the user decides to move from the premises and take the shower curtain structure with him.

The device 2 is generally very useful in smaller apartments where the bathroom facilities tend to be undersized and cramped and minimally developed. In addition, it is particularly handy for singles or small families who tend to move many times in the early stages of family life. The portability of the device 2 is an important factor in minimizing the cost of providing a secure shower system to prevent water from splashing on the floor and messing up the room in general. It also provides a simple and secure means of excluding curious pets from messing up or getting into trouble and even drowning in shower facilities.

Installing the device 2 usually requires simple tools such as a screwdriver or utility knife and perhaps a hacksaw to adjust the length of the channels. The curtain may be installed around the grommet simply by the use of one's hands and if necessary, the utilization of an ordinary screwdriver.

Finally, an alternate embodiment may comprise shower enclosures that are round or require two curtains 20 that open from the center or ends. A modification of the inner channel may be manufactured to connect the center curtains. A unit, consisting of two inner channels and one outer channel would be used. One inner channel would have an outer channel permanently adhered to it, with the open end of the outer channel facing outward. One of the center curtain edges would be inserted into the inner channel with the outer channel connected to it, and secured by the spline. The other center curtain would be inserted into another inner channel. The two inner channels and one outer channel would connect in the center. The curtain could be opened and closed in the center. Two standard units could be placed on the left and right enclosure walls and curtain edges so that the curtain could be opened from either side as well as the center.

While the invention has been explained by a detailed description of certain specific embodiments, it is understood that various modifications and substitutions can be made in any of them within the scope of the appended claims which are intended also to include equivalents of such embodiments.

What is claimed is:

1. A shower enclosure for bath tubs having a rear wall and sidewalls at each end thereof comprising:

a retention frame mounted on each sidewall comprising a U-shaped channel having a base and outwardly extending legs;

a first magnet mounted on said base;

a shower rod extending between and above said retention frames having a shower curtain mounted thereon and extending downwardly to engage the tub;

a vertical U-shaped channel having a base and outwardly extending legs mounted to each end of the shower curtain having vertical ridges on said legs and a locking rod running lengthwise, said shower curtain being rolled about said locking rod and press fitted into the vertical U-shaped channel;

a second magnet mounted on said channel base;

wherein the vertical U-shaped channel engages the U-shaped retention frame with the first and second magnets in engagement to affect a shower closure.

2. A shower enclosure for bath tubs having a rear wall and side walls at each end thereof in accordance with claim 1 wherein:

the retention frame extends vertically from the tub with said U-shaped channels having the base of each channel affixed to an end wall and the sides extending outwardly to engage the U-shaped channels on the end of the shower curtain.

3. A shower enclosure for bath tubs having a rear wall and side walls at each end thereof in accordance with claim 2 wherein:

the locking rod comprises rigid PVC.

4. A shower enclosure for bath tubs having a rear wall and side walls at each end thereof in accordance with claim 2 wherein:

the locking rod is pressed fitted into the U-shaped channel at each end of the curtain.

5. A shower enclosure for bath tubs having a rear wall and side walls at each end thereof in accordance with claim 2 wherein:

the base of the vertical U-shaped channel is slightly smaller than the base of the U-shaped retention channel so that the vertical channel may be press fitted therein.

6. A shower enclosure for bath tubs having a rear wall and side walls at each end thereof in accordance with claim 2 wherein:

the vertical ridges engage and retain the locking rod within the vertical channel.

7. A shower enclosure for bath tubs having a rear wall and side walls at each end thereof in accordance with claim 2 wherein:

the base of the retention channel includes fastening means to mount said channel on the side wall.

8. A shower enclosure for bath tubs having a rear wall and side walls at each end thereof in accordance with claim 7 wherein:

the fastening means comprises double stick tape.

9. A shower enclosure for bath tubs having a rear wall and side walls at each end thereof in accordance with claim 2 wherein:

the vertical channels end include a handle mounted on the exterior thereof to open the curtain.

* * * * *